US008443746B2

(12) United States Patent
Pegg et al.

(10) Patent No.: US 8,443,746 B2
(45) Date of Patent: May 21, 2013

(54) ELEVATED WALKWAY FOR IMPROVED CABIN HEIGHT

(75) Inventors: William S. Pegg, Nashville, GA (US); Michael J. Fafard, Nashville, GA (US); Michael Anthony Werle, Nashville, GA (US)

(73) Assignee: Chaparral Boats, Inc., Nashville, GA (US)

( * ) Notice: Subject to any disclaimer, the term of this patent is extended or adjusted under 35 U.S.C. 154(b) by 48 days.

(21) Appl. No.: 12/646,148

(22) Filed: Dec. 23, 2009

(65) Prior Publication Data

US 2011/0146562 A1 Jun. 23, 2011

(51) Int. Cl.
*B63B 17/00* (2006.01)

(52) U.S. Cl.
USPC ..... 114/65 R

(58) Field of Classification Search
USPC ..... D12/300, 315; 114/65 R, 78, 71, 114/343, 364, 85
See application file for complete search history.

(56) References Cited

U.S. PATENT DOCUMENTS

| | | | | |
|---|---|---|---|---|
| 3,475,773 | A * | 11/1969 | Codman, Jr. | 114/361 |
| 4,064,584 | A | 12/1977 | Funkhouser | 3/48 |
| 4,425,861 | A | 1/1984 | Raikamo | 29/2 |
| 5,349,919 | A * | 9/1994 | Douglass | 114/61.33 |
| 5,431,120 | A | 7/1995 | Ancarola | 9/4 |
| 7,040,244 | B1 | 5/2006 | Ferran | 1/12 |
| 2005/0204983 | A1 * | 9/2005 | Dykes et al. | 114/78 |
| 2009/0227157 | A1 | 9/2009 | Mochizuki | 20/8 |

OTHER PUBLICATIONS

Quest Watersports 2007 Stingray 250CR http://www.questwatersports.com/2007-stingray-250cr--c-872.htm.*

Thunder Road 2007 Stingray 250CR http://www.thunderroadmarine.com/new_vehicle_features.asp?veh=44553&CatDesc=.*

International Search Report, PCT/US2010/061266, filed Dec. 20, 2010, Chaparral Boats, Inc. et al., mailed Sep. 14, 2011.

* cited by examiner

*Primary Examiner* — Edwin Swinehart
(74) *Attorney, Agent, or Firm* — Fish & Richardson P.C.

(57) ABSTRACT

Boats including elevated walkways that are useful for increasing cabin height in a boat, such as a bow rider style boat, are described. Such elevated walkways are elevated relative to either a cockpit deck portion or a deck portion of a bow area and can be used to connect the bow area to the cockpit area. The cabin of a boat with an elevated walkway as described is located at least partially below the elevated walkway. The portion of the cabin below the elevated walkway has a ceiling area that is elevated relative to either the deck portion of the bow area or the cockpit area deck portion where the elevated walkway overlaps the cabin space. Elevated walkways as described herein are located on the boat such that they either overlap the central longitudinal axis of the boat or the end of the elevated walkway near the cockpit is located between port and starboard dash consoles.

16 Claims, 5 Drawing Sheets

ELEVATED WALKWAY FOR IMPROVED CABIN HEIGHT

BACKGROUND

The interior cabin area of a boat is limited by the boat's exterior configuration. As a boat's exterior dimensions get smaller, the available interior space into which a cabin can be formed similarly decreases to a point at which interior cabin space is severely limited or not even possible. The boat making industry has developed several exterior features to help maximize interior cabin space. For example, some sport boats have raised cabin tops in the forward portion of the boat that are non-utilitarian deck areas, i.e., the cabin top is designed to keep water out, but not necessarily for any particular crew activity on its exterior surface. Such raised cabin tops increase the interior area of the cabin, but place limits on the use of exterior deck space. To access the forward portions of the boat deck, a center walkway between two dash panels is often utilized. Such center walkways are often designed to be the same level as the cockpit, which may be lower than the cabin top, such that they impinge on the available interior cabin space.

SUMMARY

Boats including a bow area, a cockpit, an elevated walkway, and a cabin are described. The cockpit is located behind the bow area and both include deck portions. The elevated walkway extends between the cockpit and the bow area and overlaps the longitudinal axis of the boat. The elevated walkway is elevated relative to either the cockpit deck portion or the deck portion of the bow area. The cabin is located at least partially below the elevated walkway.

Additional boats including a bow area, a cockpit, an elevated walkway, and a cabin are described. The cockpit of these boats is located behind the bow area and both include deck portions. The cockpit further includes a port dash console and a starboard dash console. The elevated walkway extends between the cockpit and the bow area, is elevated relative to either the cockpit deck portion or the deck portion of the bow area, and the portion of the elevated walkway proximate the cockpit is located between the port dash console and the starboard dash console. The cabin is located at least partially below the elevated walkway.

DESCRIPTION OF DRAWINGS

Like reference symbols in the various drawings indicate like elements.

DETAILED DESCRIPTION

Boats including elevated walkways that are useful for increasing cabin height in a boat, such as a bow rider style boat, are described. Such elevated walkways can be used to connect a bow area to a cockpit area. The elevated walkway is elevated relative to either the cockpit deck portion or the deck portion of the bow area. The cabin of a boat with an elevated walkway as described herein is located at least partially below the elevated walkway. The portion of a cabin below the elevated walkway has a ceiling area that is elevated relative to either the deck portion of the bow area or the cockpit deck portion where the elevated walkway overlaps the cabin space. Elevated walkways as described herein are located on the boat such that they either overlap the central longitudinal axis of the boat or the end of the elevated walkway near the cockpit is located between port and starboard dash consoles.

Figure 1:
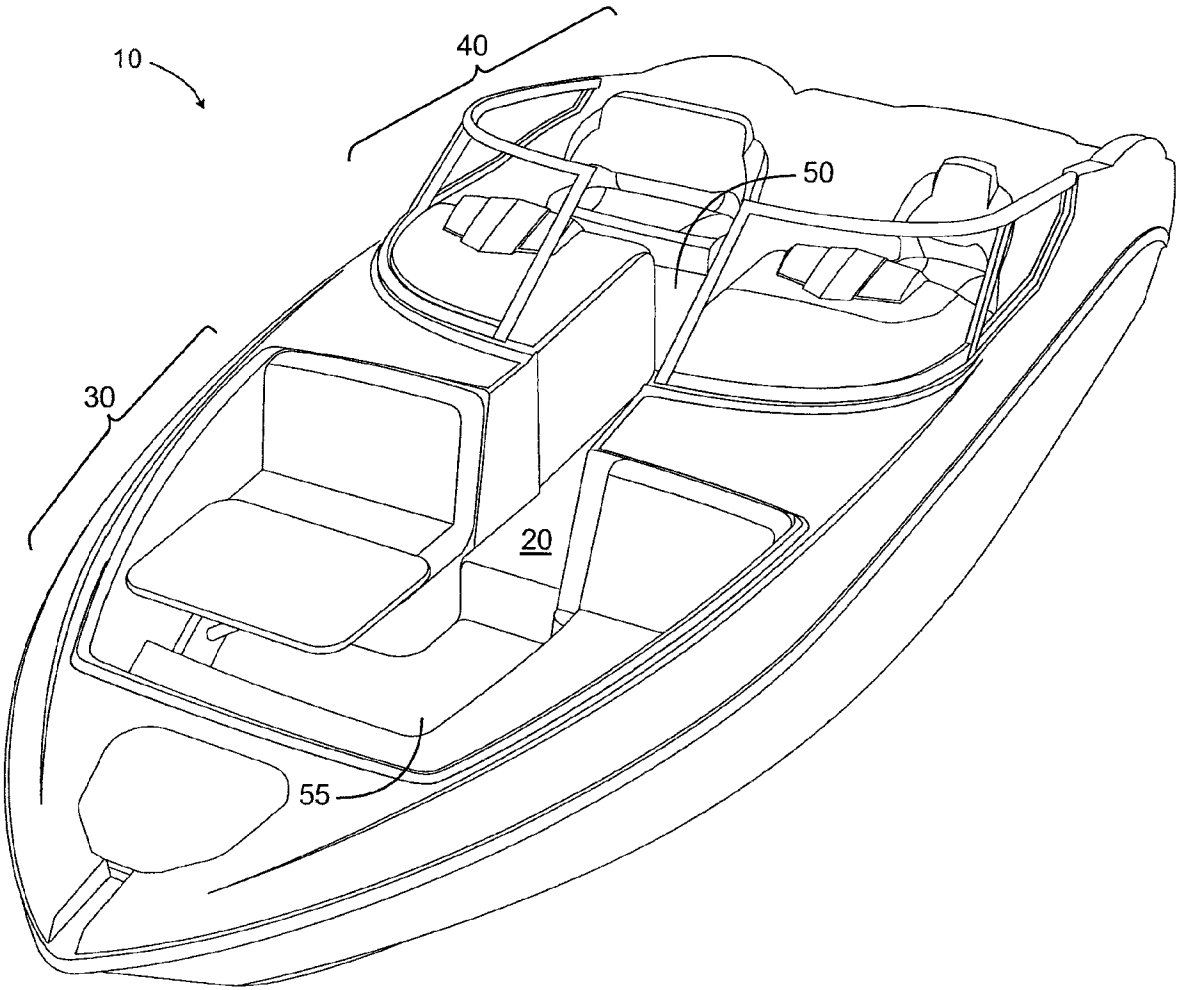
FIG. 1 is a perspective view of an example of a boat with an elevated walkway connecting the bow area to the cockpit.

FIG. 1 shows a perspective view of one example of a boat 10 with an elevated walkway 20. The boat shown in FIG. 1, has a bow area 30, a cockpit 40, and an elevated walkway 20 extending between the bow area 30 and the cockpit 40. The cockpit 40 is located behind, i.e., aft, the bow area 30 and includes a deck portion 50. The bow area 30 also includes a deck portion 55. The elevated walkway 20 is elevated relative to either the cockpit deck portion 50 or the deck portion 55 of the bow area 30. Similarly, the elevated walkway 20 can be elevated relative to both the cockpit deck portion 50 and the deck portion 55 of the bow area 30.

Figure 2:
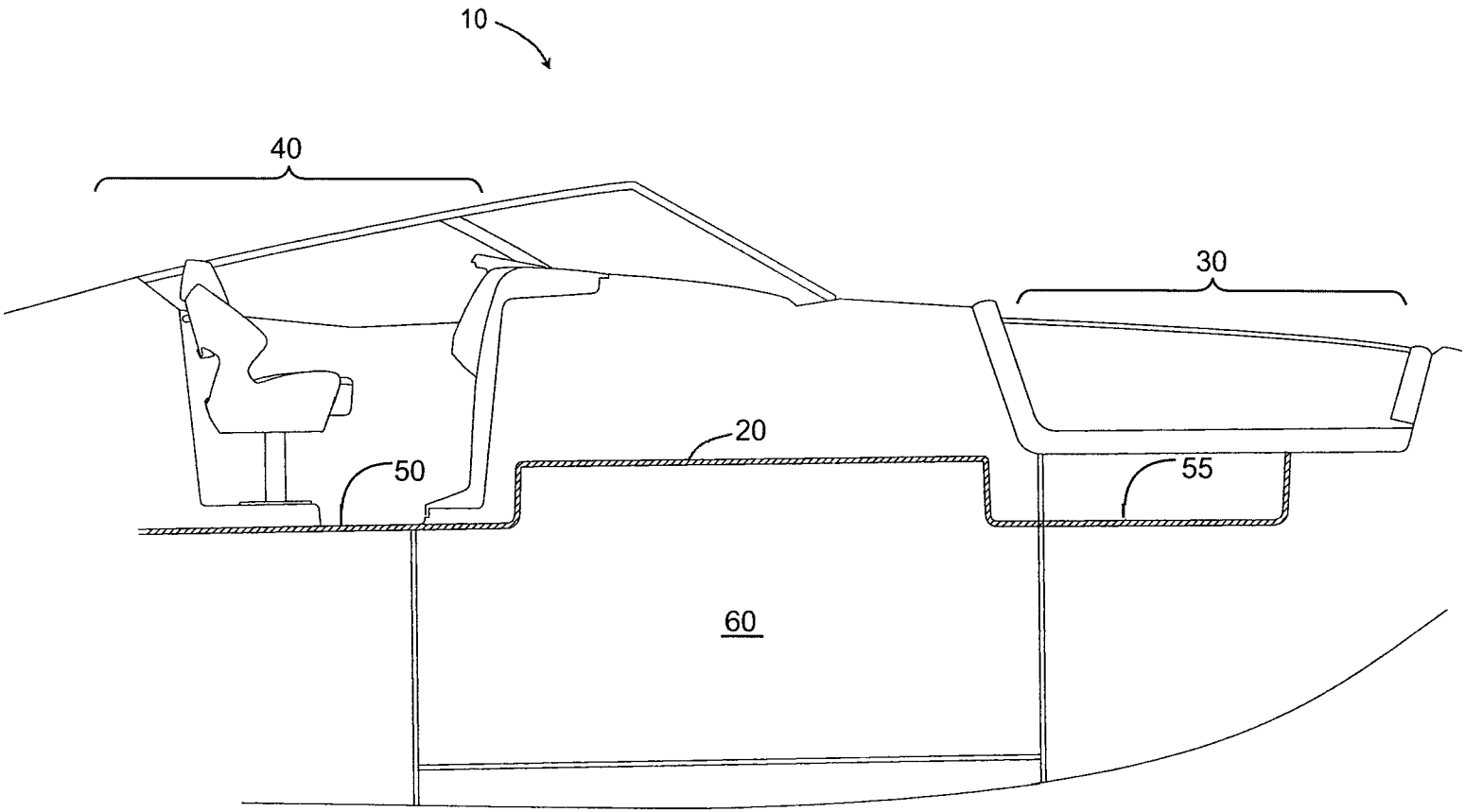
FIG. 2 is a cross-sectional view of the boat shown in FIG. 1 looking from the middle of the boat toward the port side (the cross-section being taken along the longitudinal axis of the boat from bow to stern).
Figure 3:
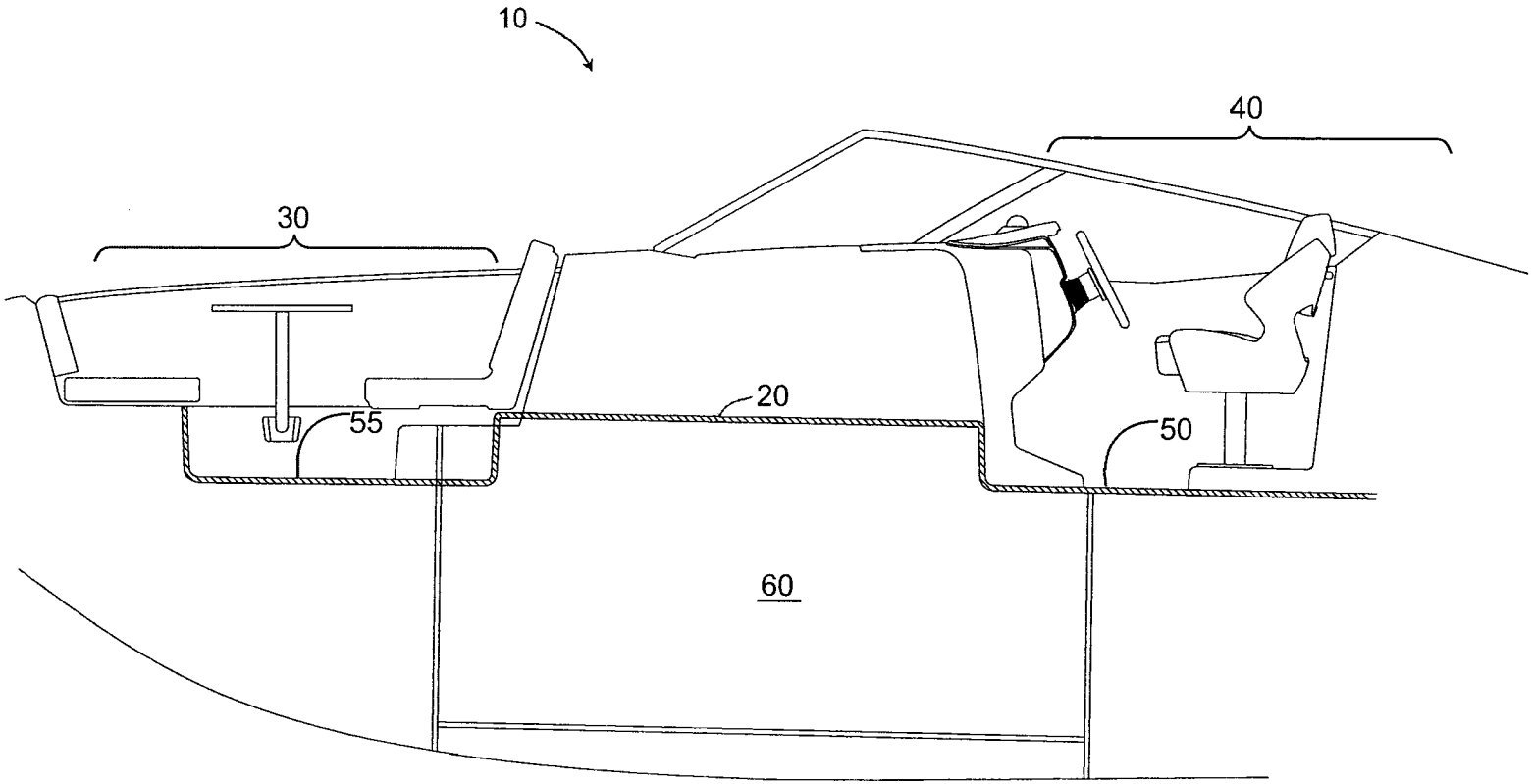
FIG. 3 is a cross-sectional view of the boat shown in FIG. 1 looking from the middle of the boat toward the starboard side (the cross-section being taken along the longitudinal axis of the boat from bow to stern).

FIGS. 2 and 3 are cross-sectional views of the boat 10 from FIG. 1. FIG. 2 is a cross-sectional view of the boat 10 looking from the middle of the boat 10 toward the port side (the cross-section being taken along the longitudinal axis of the boat from bow to stern). FIG. 3 is a cross-sectional view of the boat 10 looking from the middle of the boat 10 toward the starboard side (the cross-section being taken along the longitudinal axis of the boat from bow to stern). Both FIGS. 2 and 3 show a cabin 60 located at least partially below the elevated walkway. In the specific example shown in FIGS. 2 and 3, the elevated walkway 20 is elevated relative to both the deck portion 55 of the bow area 30 and cockpit deck portion 50. However, in other examples, the elevated walkway 20 can be elevated relative to only the deck portion 55 of the bow area 30 or only the cockpit deck portion 50. Similarly, in further examples, the elevated walkway 20 can be elevated at different levels relative to the cockpit deck portion 50 and the deck portion 55 of the bow area 30. For example, the cockpit deck portion 50 can be lower in elevation than the deck portion 55 of the bow area 30, while elevated walkway 20 is elevated relative to both the cockpit deck portion 50 and the deck portion 55 of the bow area 30. The elevated walkway 20 can be elevated 1 or more inches, 2 or more inches, 3 or more inches, 4 or more inches, 5 or more inches, 6 or more inches, 8 or more inches, 10 or more inches, 12 or more inches, 14 or more inches, 16 or more inches, 18 or more inches, 20 or more inches, or 24 or more inches above either the cockpit deck portion 50 or the deck portion 55 of the bow area 30. Steps or a ramp, for example, can be used to transition between the cockpit deck portion 50 or the deck portion 55 of the bow area 30 onto the elevated walkway 20.

Figure 4:
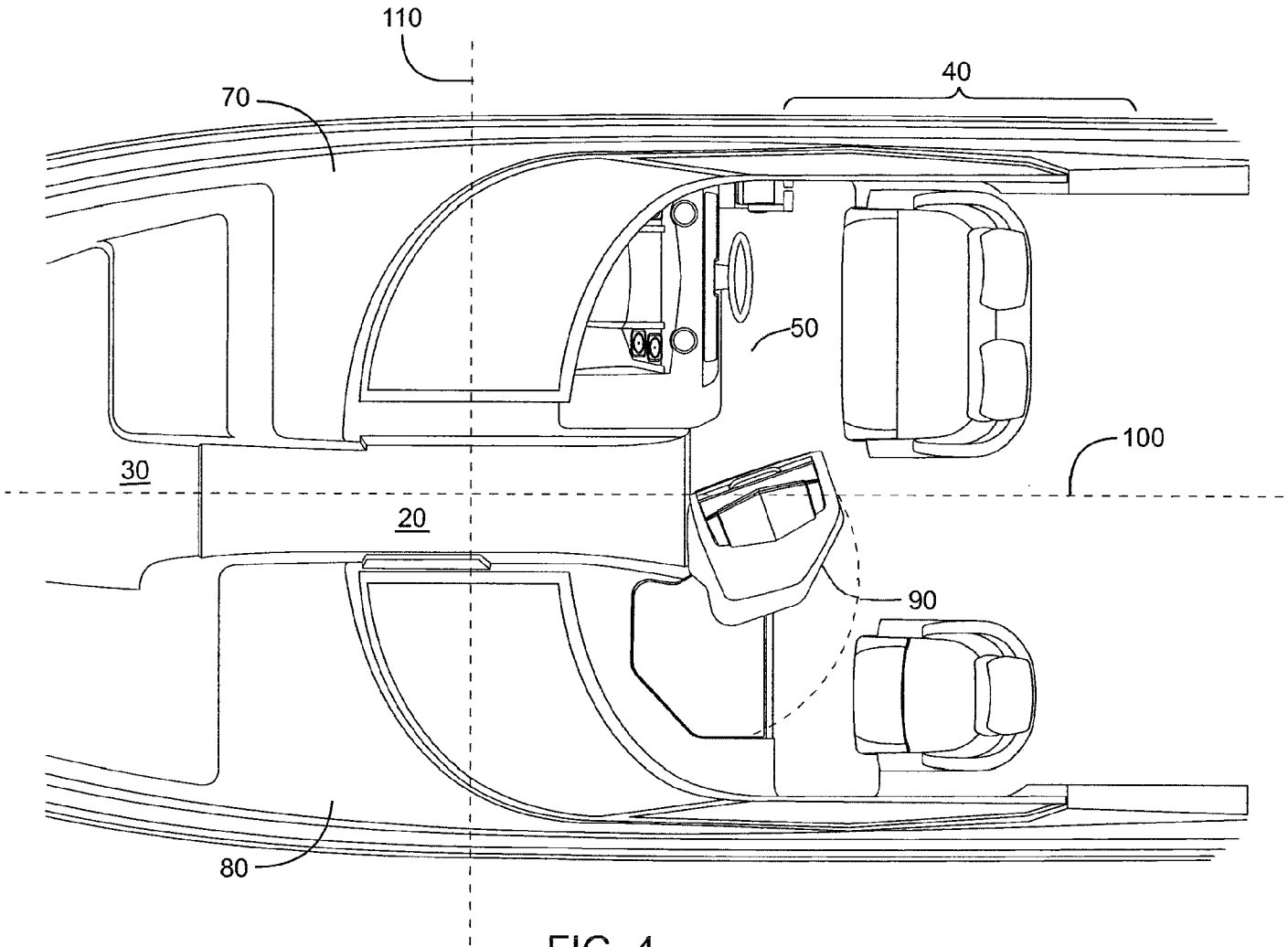
FIG. 4 is a top view of the boat shown in FIG. 1.

FIG. 4 shows a top view of the boat 10 with the elevated walkway 20 connecting the cockpit 40 to the bow area 30. FIG. 4 also shows a starboard dash panel 70 and a port dash panel 80. As shown in this particular example of boat 10, the starboard dash panel 70 houses an operating station and the port dash panel 80 houses a cabin door 90 to provide access to the cabin 60. Access to the cabin 60 can be located at alternate positions that will be apparent to those of skill in the art. As shown in FIG. 4, in this example of a boat 10, the elevated walkway 20 proximate the cockpit 40 is located between the starboard dash panel 70 and a port dash panel 80. The starboard dash panel 70 and port dash panel 80 can be different sizes depending on the design of a particular boat. FIG. 4 also shows the longitudinal axis 100 of the boat 10, i.e., the longitudinal axis 100 running from bow to stern. The elevated walkway 20 shown in FIG. 4 overlaps the longitudinal axis 100 of the boat 10. Depending on the relative sizes of the starboard dash panel 70 and a port dash panel 80, the elevated walkway 20 can be located such that it does not overlap the longitudinal axis 100 or a boat while the portion of the elevated walkway 20 proximate the cockpit 40 is located between the starboard dash panel 70 and a port dash panel 80.

Figure 5:
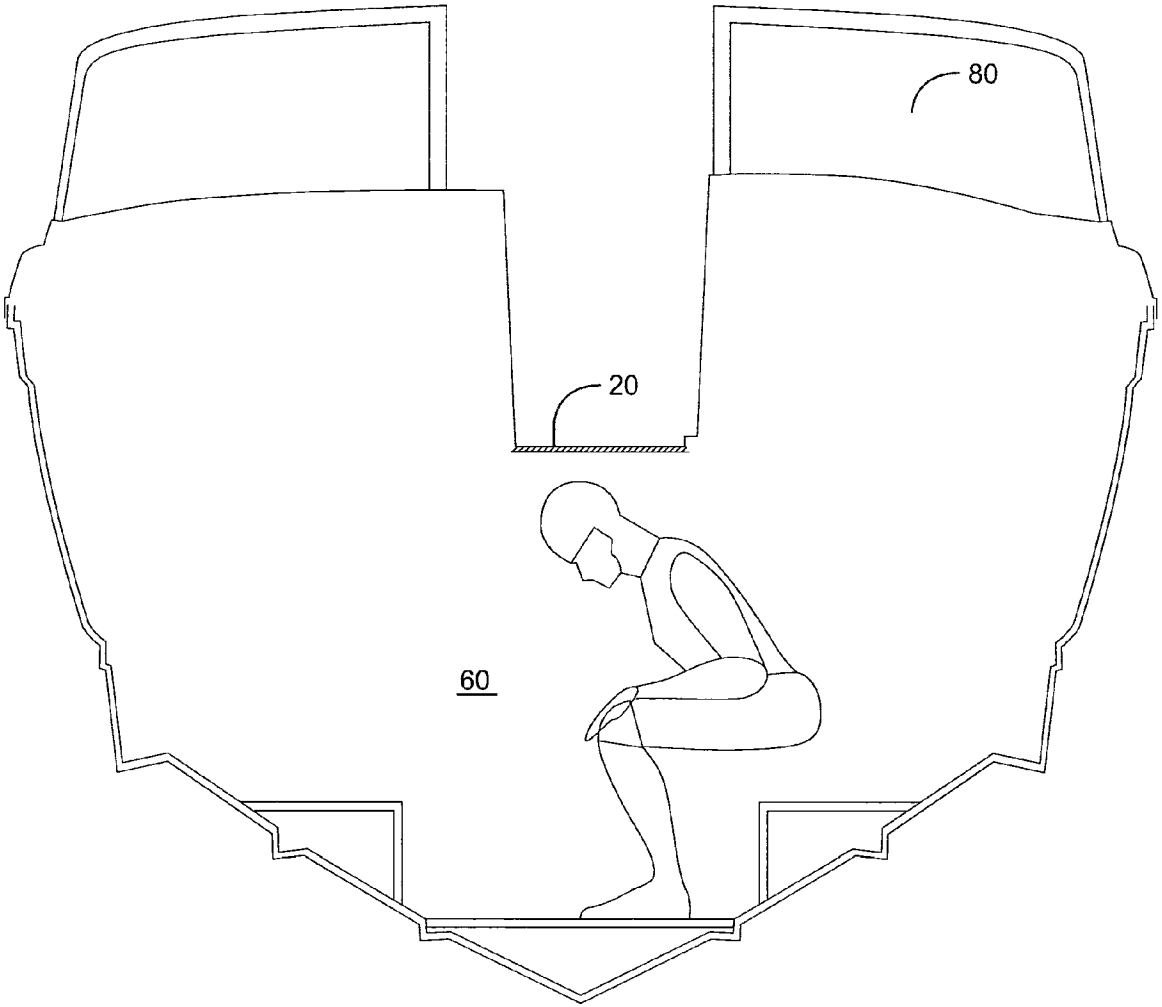
FIG. 5 is a cross-sectional view of the boat shown in FIG. 1 looking from the bow toward the stern (the cross-section being taken perpendicular to the longitudinal axis of the boat within the length of the elevated walkway).

FIG. 5 shows a cross-sectional view of the boat 10 at axis 110 (shown in FIG. 4) looking from the bow toward the stern (the axis 110 being perpendicular to the longitudinal axis of the boat within the length of the elevated walkway 20). The cabin 60, as shown in FIG. 5, is located at least partially beneath the elevated walkway 20. The cabin 60 may include one or more steps, seating areas, one or more berths, a galley, a head, or combinations of these. For example, a cabin 60 may include a seating area, a berth, a galley, and a head. A berth located in the cabin 60 can be a full beam berth. The cabin 60 may also include other areas used in boat cabins such as storage areas and general use cabin areas.

An additional example of a boat 10 has a bow area 30, a cockpit 40, and an elevated walkway 20 extending between the bow area 30 and the cockpit 40. The cockpit 40 is located behind, i.e., aft, the bow area 30 and includes a deck portion 50, a starboard dash console 70, and a port dash console 80. The elevated walkway 20 is elevated relative to either the cockpit deck portion 50 or the deck portion 55 of the bow area 30. The bow area 30 also includes a deck portion 55. The elevated walkway 20 proximate the cockpit 40 is located between the starboard dash console 70 and the port dash console 80.

The claims set forth below are not limited in scope by the examples disclosed herein which are intended as illustrations of a few aspects of the claims and any examples which are functionally equivalent are within the scope of the claims. Various modifications of the boats shown herein in addition to those shown and described will become apparent to those skilled in the art and are intended to fall within the scope of the claims. Further, while only certain representative combinations of boat structural elements disclosed herein are specifically discussed in the examples above, other combinations of boat structural elements will become apparent to those skilled in the art and also are intended to fall within the scope of the appended claims. Further, those of skill in the art will understand that other boat structural elements, such as seats, controls, and other items and features used on boats can be added to the boats described herein. Thus a combination of boat structural elements may be explicitly mentioned herein; however, other combinations of boat structural elements and features are included, even though not explicitly stated. The term "comprising" and variations thereof as used herein is used synonymously with the term "including" and variations thereof and are open, non-limiting terms.

What is claimed is:

1. A boat comprising:

a forward portion, the forward portion comprising an upper deck and a bow area, the bow area including a deck portion and seating configured for human passengers, wherein the bow area is bordered on a starboard side and a port side by the upper deck, and wherein the upper deck is at a higher elevation than the deck portion of the bow area;

a cockpit, the cockpit located behind the bow area and including a cockpit deck portion;

an elevated walkway, the elevated walkway overlapping the longitudinal axis of the boat and extending between the cockpit and the bow area, a portion of the elevated walkway being bordered on a starboard side by a first substantially vertical wall, and on a port side by a second substantially vertical wall; and a cabin, the cabin located at least partially below the elevated walkway, wherein the elevated walkway is elevated relative to the cockpit deck portion or the deck portion of the bow area, and wherein the elevated walkway is at a lower elevation than the upper deck of the forward portion, and the elevated walkway is elevated relative to the cockpit deck portion and the deck portion of the bow area.

2. The boat of claim 1, wherein the elevated walkway is elevated at a first level that is higher or lower than the relative levels of the cockpit deck portion and the deck portion of the bow area.

3. The boat of claim 2, wherein the cockpit deck portion is lower in elevation than the deck portion of the bow area.

4. The boat of claim 1, wherein the elevated walkway is elevated 1 inch or more.

5. The boat of claim 1, wherein the cockpit further comprises a port dash console and a starboard dash console.

6. The boat of claim 5, wherein the elevated walkway proximate the cockpit is located between the port dash console and the starboard dash console.

7. The boat of claim 5, wherein an entryway into the cabin is located in the port dash console.

8. The boat of claim 1, wherein the cabin further comprises a seating area or berth.

9. The boat of claim 1, wherein the cabin further comprises a full beam berth or cabin area.

10. A boat comprising:

a forward portion, the forward portion comprising an upper deck and a bow area including a deck portion and seating configured for human passengers, wherein the bow area is bordered on a starboard side and a port side by the upper deck, and wherein the upper deck is at a higher elevation than the deck portion of the bow area;

a cockpit, the cockpit located behind the bow area and including a cockpit deck portion, a port dash console, and a starboard dash console;

an elevated walkway, the elevated walkway extending between the cockpit and the bow area, a portion of the elevated walkway being bordered on a starboard side by a first substantially vertical wall, and on a port side by a second substantially vertical wall; and a cabin, the cabin located at least partially below the elevated walkway, wherein the elevated walkway is elevated relative to the cockpit deck portion or the deck portion of the bow area and the portion of the elevated walkway proximate the cockpit is located between the port dash console and the starboard dash console, and wherein the elevated walkway is at a lower elevation than the upper deck of the forward portion, and the elevated walkway is elevated relative to the cockpit deck portion and the deck portion of the bow area.

11. The boat of claim 10, wherein the elevated walkway is elevated at a first level that is higher or lower than the relative levels of the cockpit deck portion and the deck portion of the bow area.

12. The boat of claim 11, wherein the cockpit deck portion is higher in elevation than the deck portion of the bow area.

13. The boat of claim 10, wherein the elevated walkway is elevated 1 inch or more.

14. The boat of claim 10, wherein an entryway into the cabin is located in the port dash console.

15. The boat of claim 10, wherein the cabin further comprises a seating area or berth.

16. The boat of claim 10, wherein the cabin further comprises a full beam berth or cabin area.

* * * * *